US010608323B2

(12) United States Patent
Choi et al.

(10) Patent No.: US 10,608,323 B2
(45) Date of Patent: Mar. 31, 2020

(54) ELECTRONIC DEVICE INCLUDING MULTI-BAND ANTENNA

(71) Applicant: Samsung Electronics Co., Ltd., Gyeonggi-do (KR)

(72) Inventors: Sang Hoon Choi, Gyeonggi-do (KR); In Young Lee, Gyeonggi-do (KR); Woo Suk Kang, Seoul (KR); Tae Young Kim, Gyeonggi-do (KR); Jae Bong Chun, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 235 days.

(21) Appl. No.: 15/695,689

(22) Filed: Sep. 5, 2017

(65) Prior Publication Data

US 2018/0069300 A1 Mar. 8, 2018

(30) Foreign Application Priority Data

Sep. 5, 2016 (KR) ..... 10-2016-0113682

(51) Int. Cl.
*H01Q 1/24* (2006.01)
*H01Q 9/04* (2006.01)
(Continued)

(52) U.S. Cl.
CPC ..... *H01Q 1/243* (2013.01); *G04G 9/0064* (2013.01); *G04G 21/04* (2013.01); *G04R 60/02* (2013.01);
(Continued)

(58) Field of Classification Search
CPC ..... H01Q 1/243; H01Q 5/357; H01Q 1/273; H01Q 9/0421; H01Q 21/28; H01Q 21/30;
(Continued)

(56) References Cited

U.S. PATENT DOCUMENTS 7,215,600 B1 5/2007 DeRosa
7,271,774 B2 9/2007 Puuri
(Continued)

FOREIGN PATENT DOCUMENTS

CN 105848433 8/2016
EP 2 990 889 3/2016
(Continued)

OTHER PUBLICATIONS

European Search Report dated Jan. 22, 2018 issued in counterpart application No. 17186447.3-1205, 11 pages.
(Continued)

*Primary Examiner* — Dameon E Levi
*Assistant Examiner* — David E Lotter
(74) *Attorney, Agent, or Firm* — The Farrell Law Firm, P.C.

(57) ABSTRACT

Disclosed is an electronic device including a housing that includes a first conductive member disposed on a first surface facing a first direction and a second conductive member disposed adjacent to a second surface facing a second direction opposite to the first direction, a nonconductive member that is located between the first conductive member and the second conductive member and forms part of the housing, a printed circuit board (PCB), a communication circuit that is disposed on the PCB and is electrically connected with the first conductive member and the second conductive member, and a ground part that is electrically connected with at least one of the first conductive member and the second conductive member. The communication circuit feeds the first conductive member and the second conductive member and transmits/receives a signal through the first conductive member and the second conductive member.

19 Claims, 14 Drawing Sheets

(51) Int. Cl.

| | |
|---|---|
| ***H01Q 21/28*** | (2006.01) |
| ***H01Q 21/30*** | (2006.01) |
| ***H01Q 25/00*** | (2006.01) |
| ***H01Q 5/35*** | (2015.01) |
| ***G04G 9/00*** | (2006.01) |
| ***G04G 21/04*** | (2013.01) |
| ***G04R 60/02*** | (2013.01) |
| ***G04R 60/06*** | (2013.01) |
| ***H01Q 1/27*** | (2006.01) |

(52) U.S. Cl.
CPC ..... *G04R 60/06* (2013.01); *H01Q 1/273* (2013.01); *H01Q 5/35* (2015.01); *H01Q 9/0421* (2013.01); *H01Q 21/28* (2013.01); *H01Q 21/30* (2013.01); *H01Q 25/005* (2013.01)

(58) Field of Classification Search
CPC ..... G04G 9/0064; G04G 21/04; G04R 60/02; G04R 60/06
See application file for complete search history.

(56) References Cited

U.S. PATENT DOCUMENTS

| | | | | |
|---|---|---|---|---|
| 7,612,725 | B2 | 11/2009 | Hill et al. | |
| 7,843,396 | B2 | 11/2010 | Hill et al. | |
| 7,924,231 | B2 | 4/2011 | Hill et al. | |
| 8,169,374 | B2 | 5/2012 | Hill et al. | |
| 8,275,327 | B2 | 9/2012 | Yi et al. | |
| 8,833,665 | B2 | 9/2014 | Grange et al. | |
| 8,907,852 | B2 | 12/2014 | Hill et al. | |
| 9,356,355 | B2 | 5/2016 | Hill et al. | |
| 9,833,159 | B2 | 12/2017 | Chu et al. | |
| 10,297,909 | B2 | 5/2019 | Kim et al. | |
| 2007/0091004 | A1 | 4/2007 | Puuri | |
| 2008/0316115 | A1 | 12/2008 | Hill et al. | |
| 2009/0197654 | A1 | 8/2009 | Teshima et al. | |
| 2010/0112964 | A1 | 5/2010 | Yi et al. | |
| 2011/0234461 | A1 | 9/2011 | Grange et al. | |
| 2012/0112969 | A1 | 5/2012 | Caballero et al. | |
| 2014/0049432 | A1 | 2/2014 | Hill et al. | |
| 2014/0253394 | A1* | 9/2014 | Nissinen | H01Q 7/00 343/702 |
| 2015/0091764 | A1 | 4/2015 | Hsieh et al. | |
| 2015/0188217 | A1 | 7/2015 | Tsai et al. | |
| 2015/0351292 | A1* | 12/2015 | Chang | H01Q 1/526 361/749 |
| 2015/0372372 | A1 | 12/2015 | Lee et al. | |
| 2015/0380818 | A1* | 12/2015 | Svendsen | H01Q 5/307 343/700 MS |
| 2016/0062417 | A1 | 3/2016 | Chu et al. | |
| 2016/0064804 | A1 | 3/2016 | Kim et al. | |
| 2016/0124396 | A1 | 5/2016 | Choi et al. | |
| 2016/0248148 | A1 | 8/2016 | Hill et al. | |
| 2016/0254587 | A1 | 9/2016 | Jung et al. | |
| 2016/0254590 | A1 | 9/2016 | Seo et al. | |
| 2017/0025747 | A1* | 1/2017 | Vanjani | H01Q 1/273 |
| 2017/0207524 | A1* | 7/2017 | Cardinali | H05K 3/284 |
| 2018/0034152 | A1* | 2/2018 | Mura | H04B 1/006 |

FOREIGN PATENT DOCUMENTS

| | | |
|---|---|---|
| EP | 3 018 540 | 5/2016 |
| WO | WO 2016/137175 | 9/2016 |

OTHER PUBLICATIONS

European Search Report dated Nov. 26, 2018 issued in counterpart application No. 17186447.3-1205, 11 pages.
European Search Report dated Jul. 24, 2019 issued in counterpart application No. 17186447.3-1205, 12 pages.

* cited by examiner

ELECTRONIC DEVICE INCLUDING MULTI-BAND ANTENNA

PRIORITY

This application claims priority under 35 U.S.C. § 119(a) to Korean Patent Application Serial No. 10-2016-0113682, which was filed in the Korean Intellectual Property Office on Sep. 5, 2016, the entire content of which is incorporated herein by reference.

BACKGROUND

1. Field of the Disclosure

The present disclosure relates to an electronic device capable of transmitting/receiving a signal through an antenna.

2. Description of the Related Art

The use of a wearable electronic device is increasing as electronic device technology progresses. The wearable electronic device may include a communication function to perform various functions such as voice call, message confirmation, wireless payment, and the like.

The wearable electronic device may be manufactured with a small size so it can be easily mounted on a portion of the user's body, for example, a wrist. The wearable electronic device may have an insufficient space to mount an antenna. If the metallic parts are disposed adjacent to the antenna due to the insufficient space, the performance of the antenna may be reduced. For example, a signal may be induced at a metal component, thereby reducing reception efficiency of the antenna.

SUMMARY

Aspects of the present disclosure are to address at least the above mentioned problems and/or disadvantages and to provide at least the advantages described below.

In accordance with an aspect of the present disclosure, an electronic device includes a housing that includes a first conductive member disposed on a first surface facing a first direction and a second conductive member disposed adjacent to a second surface facing a second direction opposite to the first direction, a nonconductive member that is located between the first conductive member and the second conductive member and forms part of the housing, a printed circuit board (PCB), a communication circuit that is disposed on the PCB and is electrically connected with the first conductive member and the second conductive member, and a ground part that is electrically connected with at least one of the first conductive member and the second conductive member. The communication circuit feeds the first conductive member and the second conductive member and transmits/receives a signal through the first conductive member and the second conductive member.

In accordance with another aspect of the present disclosure, an electronic device includes a housing that includes a first conductive member disposed on a first surface facing a first direction, a second conductive member disposed adjacent to a second surface facing a second direction opposite to the first direction, and a nonconductive member located between the first conductive member and the second conductive member, a printed circuit board (PCB), a communication circuit that is disposed on the PCB and is electrically connected with the first conductive member, a ground part electrically connected with the first conductive member, and an antenna radiator that is disposed on the nonconductive member and is electrically connected with the communication circuit and the ground part. The communication circuit feeds the first conductive member to transmit/receive a signal in a first frequency band and feeds the antenna radiator to transmit/receive a signal in a second frequency band.

In accordance with another aspect of the present disclosure, an electronic device includes a housing that includes a conductive member disposed on a first surface facing a first direction and a ground part connected with the conductive member and disposed adjacent to a second surface facing a second direction opposite to the first direction, a printed circuit board (PCB), and a communication circuit that is disposed on the PCB and is electrically connected with the conductive member. The communication circuit feeds a first point of the conductive member, the conductive member is selectively connected with the ground part at a second point and a third point, and the communication circuit transmits/receives a signal in a first frequency band by an electrical path formed through the first point and the second point and transmits/receives a signal in a second frequency band by an electrical path formed through the first point and the third point.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

Figure 1:
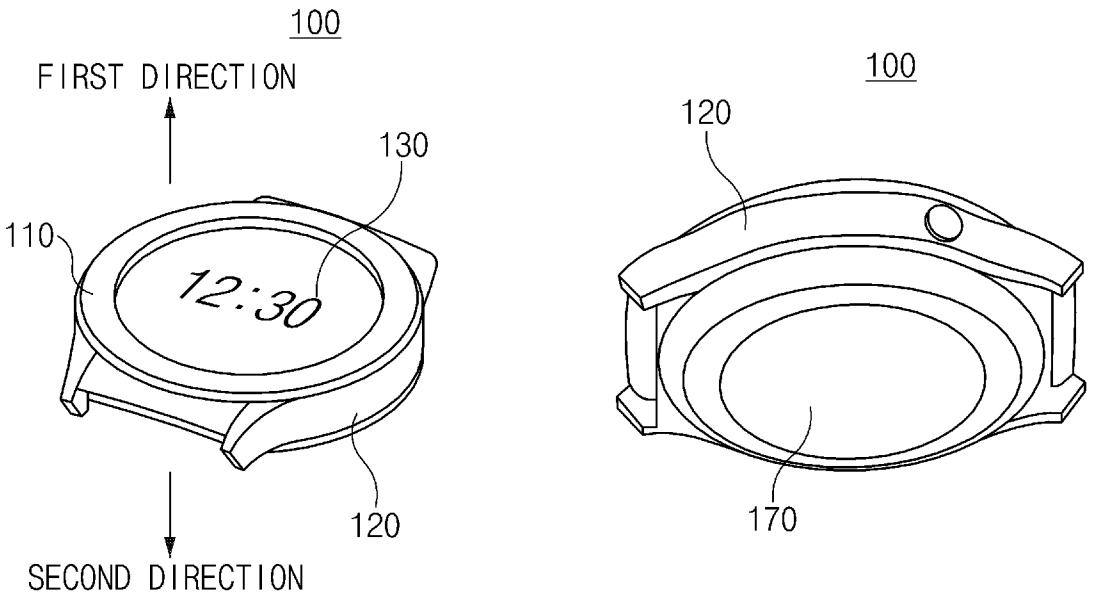
FIG. 1 illustrates a perspective view of an electronic device, according to an embodiment of the present disclosure.

Hereinafter, various embodiments of the present disclosure are described with reference to accompanying drawings. Accordingly, those of ordinary skill in the art will recognize that modifications, equivalents, and/or alternatives of the various embodiments described herein can be made without departing from the scope and spirit of the present disclosure.

In this disclosure, the expressions "have", "may have", "include" and "comprise", or "may include" and "may comprise" used herein indicate the existence of corresponding features (e.g., elements such as numeric values, functions, operations, or components) but do not exclude the presence of additional features.

In this disclosure, the expressions "A or B", "at least one of A or/and B", or "one or more of A or/and B", and the like may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used in this disclosure may be used to refer to various elements regardless of the order and/or the priority and to distinguish the relevant elements from other elements, but do not limit the elements. For example, "a first user device" and "a second user device" indicate different user devices regardless of the order or priority. For example, without departing the scope of the present disclosure, a first element may be referred to as a second element, and similarly, a second element may be referred to as a first element.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening element (e.g., a third element).

According to the situation, the expression "configured to" used in this disclosure may be interchangeably used with the expressions "suitable for", "having the capacity to", "designed to", "adapted to", "made to", or "capable of". The term "configured to" does not mean only "specifically designed to" in hardware. Instead, the expression "a device configured to" may mean that the device is "capable of" operating together with another device or other components. For example, a "processor configured to (or set to) perform A, B, and C" may mean a dedicated processor (e.g., an embedded processor) for performing a corresponding operation or a generic-purpose processor (e.g., a central processing unit (CPU) or an application processor (AP)) which performs corresponding operations by executing one or more software programs which are stored in a memory device.

Terms used in this disclosure are used to describe specified embodiments and are not intended to limit the scope of another embodiment. The terms of a singular form may include plural forms unless otherwise specified. All the terms used herein, which include technical or scientific terms, have the same meanings that are generally understood by a person skilled in the art. It will be further understood that terms, which are defined in a dictionary and commonly used, should also be interpreted as is customary in the relevant related art and not in an idealized or overly formal unless expressly so defined in various embodiments of this disclosure. In some cases, even if terms are defined in this disclosure, they may not be interpreted to exclude embodiments of this disclosure.

An electronic device according to an embodiment of the present disclosure may include smartphones, tablet personal computers (PCs), mobile phones, video telephones, electronic book readers, desktop PCs, laptop PCs, netbook computers, workstations, servers, personal digital assistants (PDAs), portable multimedia players (PMPs), Motion Picture Experts Group (MPEG-1 or MPEG-2) Audio Layer 3 (MP3) players, mobile medical devices, cameras, and wearable devices. The wearable device may include an accessory type (e.g., watches, rings, bracelets, anklets, necklaces, glasses, contact lens, and head-mounted-devices (HMDs), a fabric or garment-integrated type (e.g., an electronic apparel), a body-attached type (e.g., a skin pad or tattoos), and a bio-implantable type (e.g., an implantable circuit).

According to various embodiments, the electronic device may be a home appliance. The home appliances may include televisions (TVs), digital versatile disc (DVD) players, audios, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or PlayStation™), electronic dictionaries, electronic keys, camcorders, electronic picture frames, and the like.

According to another embodiment of the present invention, an electronic device may include various medical devices (e.g., various portable medical measurement devices (e.g., a blood glucose monitoring device, a heartbeat measuring device, a blood pressure measuring device, a body temperature measuring device, and the like), a magnetic resonance angiography (MRA), a magnetic resonance imaging (MRI), a computed tomography (CT), scanners, and ultrasonic devices), navigation devices, global navigation satellite system (GNSS), event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller machines (ATMs), points of sales (POSs) devices, and Internet of Things (IoT) devices (e.g., light bulbs, various sensors, electric or gas meters, sprinkler devices, fire alarms, thermostats, street lamps, toasters, exercise equipment, hot water tanks, heaters, boilers, and the like).

According to an embodiment of the present disclosure, the electronic device may include parts of furniture or buildings/structures, electronic boards, electronic signature receiving devices, projectors, and various measuring instruments (e.g., water meters, electricity meters, gas meters, or wave meters, and the like). The electronic device may be one of the above described devices or a combination thereof. An electronic device may be a flexible electronic device. Furthermore, an electronic device may not be limited to the above-described electronic devices and may include other electronic devices and new electronic devices according to the development of new technologies.

Hereinafter, electronic devices according to various embodiments of the present disclosure will be described with reference to the accompanying drawings. In this disclosure, the term "user" may refer to a person who uses an electronic device or may refer to a device (e.g., an artificial intelligence electronic device) that uses the electronic device.

FIG. 1 illustrates a perspective view of an electronic device 100, according to an embodiment of the present disclosure.

Referring to FIG. 1, an electronic device 100 may include a housing and a display 130. The housing may include a side housing 120 and a rear housing 170.

Figure 2:
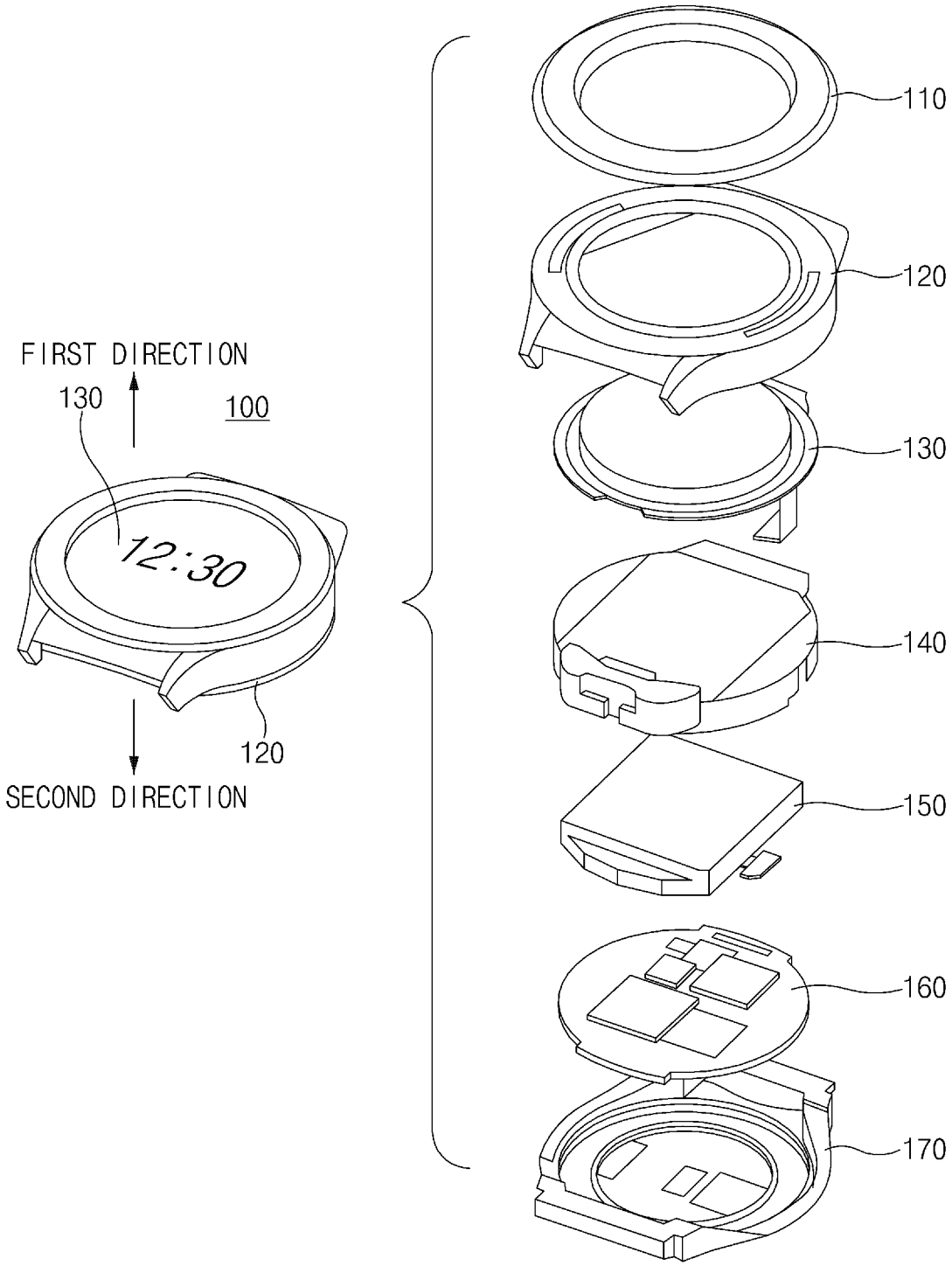
FIG. 2 illustrates an exploded perspective view of the electronic device, according to an embodiment of the present disclosure.

According to an embodiment of the present disclosure, the side housing 120 may include an opening that is defined by a through hole disposed at the center of a first surface facing a first direction. The through hole may be sized enough to expose the display 130. The side housing 120 may include a peripheral portion forming the through hole and a side wall surrounding the through hole to be perpendicular to the peripheral portion or at a specific angle. The side housing 120 may protect various elements (e.g., the display 130, a battery 150, a printed circuit board (PCB) 160, and the like, as shown in FIG. 2) disposed therein. In FIG. 1, the through hole may be circular. However, embodiments may not be limited thereto.

According to an embodiment of the present disclosure, the side housing 120 may include a first conductive member, a second conductive member, and a nonconductive member interposed between the first conductive member and the second conductive member. The first conductive member, the second conductive member, and the nonconductive member may be part of the side wall of the side housing 120. For example, the first conductive member may correspond to an uppermost portion of the side wall upon separating the side wall of the side housing 120 in a direction perpendicular to the first direction.

According to an embodiment of the present disclosure, the side housing 120 may be coupled with the rear housing 170. A button, a crown, and the like may be mounted on one side of the side housing 120. The side housing 120 may include a binding structure that is detachable from a portion of a user's body.

According to an embodiment of the present disclosure, the side housing 120 may include a conductive material (e.g., metal). If the side housing 120 includes a conductive material, the side housing 120 may be used as an antenna radiator for transmitting and receiving data to and from another electronic device. For example, the side housing 120 may be used as an antenna of a module for mobile communication such as 2G, 3G, 4G, and the like. The side housing 120 may be used as an antenna of a near field communication (NFC) module or a Bluetooth® communication module.

According to an embodiment of the present disclosure, the display 130 may be exposed to the outside through the through hole of the side housing 120. The exposed area of the display 130 may have a shape (e.g., a circular shape) corresponding to a shape of the through hole. The display 130 may include an area exposed through the through hole and an area seated inside the side housing 120. A separate glass may be attached to the area exposed through the through hole. The display 130 may include a display panel (e.g., a liquid crystal display (LCD) panel, an organic light emitting diode (OLED) panel, and the like) for displaying an image or a text, a panel receiving a user input, and the like. The display 130 may be implemented with a one cell TSP AMOLED (OCTA) display in which a touch panel and an AMOLED display are integrated.

According to an embodiment of the present disclosure, the rear housing 170 may be coupled with the side housing 120 to fix and protect internal components. The rear housing 170 may be formed of a nonmetal material or a nonconductive material.

FIG. 2 illustrates a perspective view of an electronic device, according to an embodiment of the present disclosure.

Referring to FIG. 2, the electronic device 100 may include a bezel wheel 110, the side housing 120, the display 130, a support member 140, the battery 150, the PCB 160, and the rear housing 170.

According to an embodiment of the present disclosure, the bezel wheel 110 may prevent a black matrix area of the display 130 from being exposed to the outside. The bezel wheel 110 may generate user input by rotation.

According to an embodiment of the present disclosure, the side housing 120 may include a conductive member. The conductive member may be formed on an upper portion of the display 130 (e.g., a periphery of the through hole or a periphery of the bezel wheel 110). The conductive member may be formed at a location (e.g., the side wall of the side housing 120) that is the same as or similar to the PCB 160. A resonance characteristic may vary with the location of the conductive member.

According to an embodiment of the present disclosure, the display 130 may have a whole disk shape of a specific thickness and may output an image, a text, and the like. For example, the display 130 may be implemented with various types such as an LCD type, an OLED type, and the like. In the case where the display 130 includes a touch panel, the display 130 may receive a touch input of a user and may transfer the received touch input to a processor disposed on the PCB 160.

According to an embodiment of the present disclosure, the support member 140 may fix or secure the display 130, the battery 150, the PCB 160, and the like. The support member 140 may be implemented with a nonconductive material such as plastic.

According to an embodiment of the present disclosure, the battery 150 may be electrically connected with the PCB 160. The battery 150 may supply power to the electronic device 100.

According to an embodiment of the present disclosure, a module, a chip, and the like needed to drive the electronic device 100 may be mounted on the PCB 160. The processor, a memory, a communication circuit, and the like may be mounted on the PCB 160. The PCB 160 may include a feeding part that is able to supply power to an antenna radiator and a ground layer that is connected with the antenna radiator. The feeding part may be connected to the conductive member of the side housing 120. If the conductive member is connected to the PCB 160 through the feeding part, the communication circuit may feed the conductive member, and the conductive member may operate as an antenna radiator.

Figure 3A:
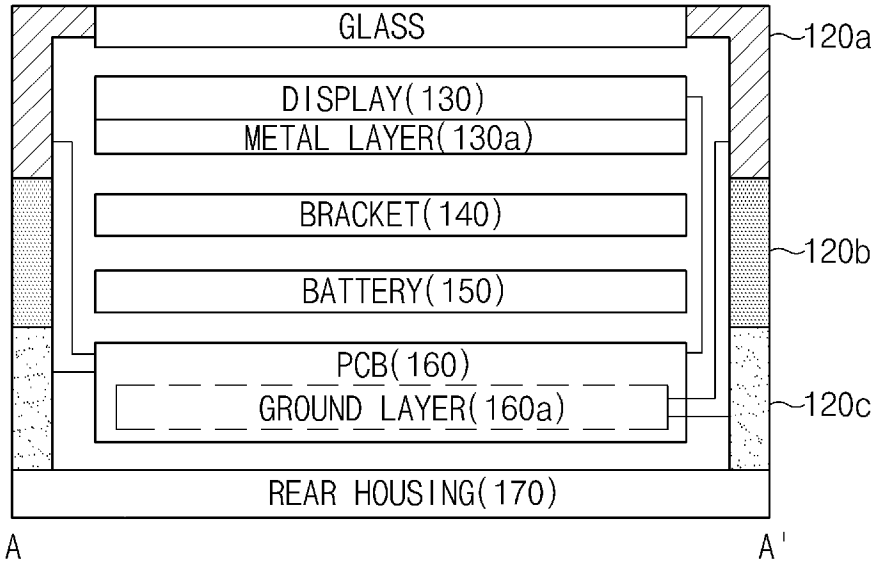
FIG. 3A illustrates a sectional view of the electronic device in which a first conductive member and a second conductive member are connected to a ground layer, according to an embodiment of the present disclosure.
Figure 3A:
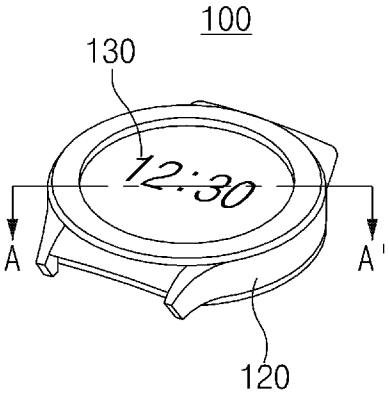
Figure 3B:
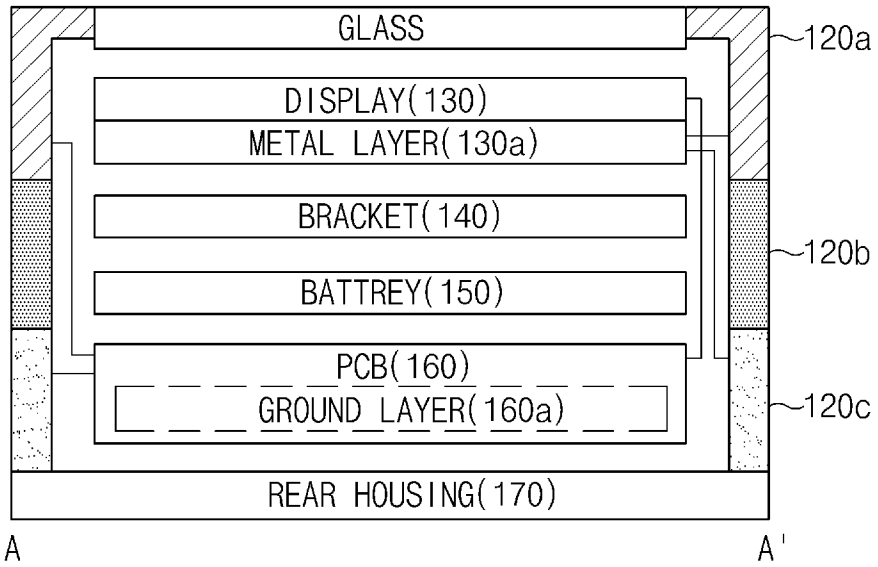
FIG. 3B illustrates a sectional view of the electronic device in which the first conductive member and the second conductive member are connected to a metal layer, according to an embodiment of the present disclosure.
Figure 3B:
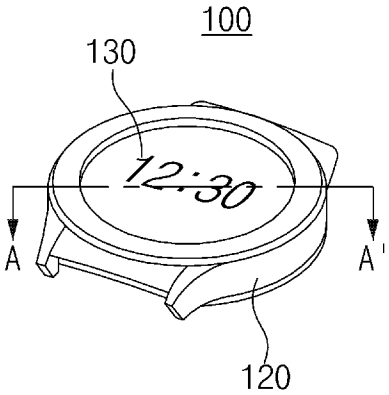
Figure 4A:
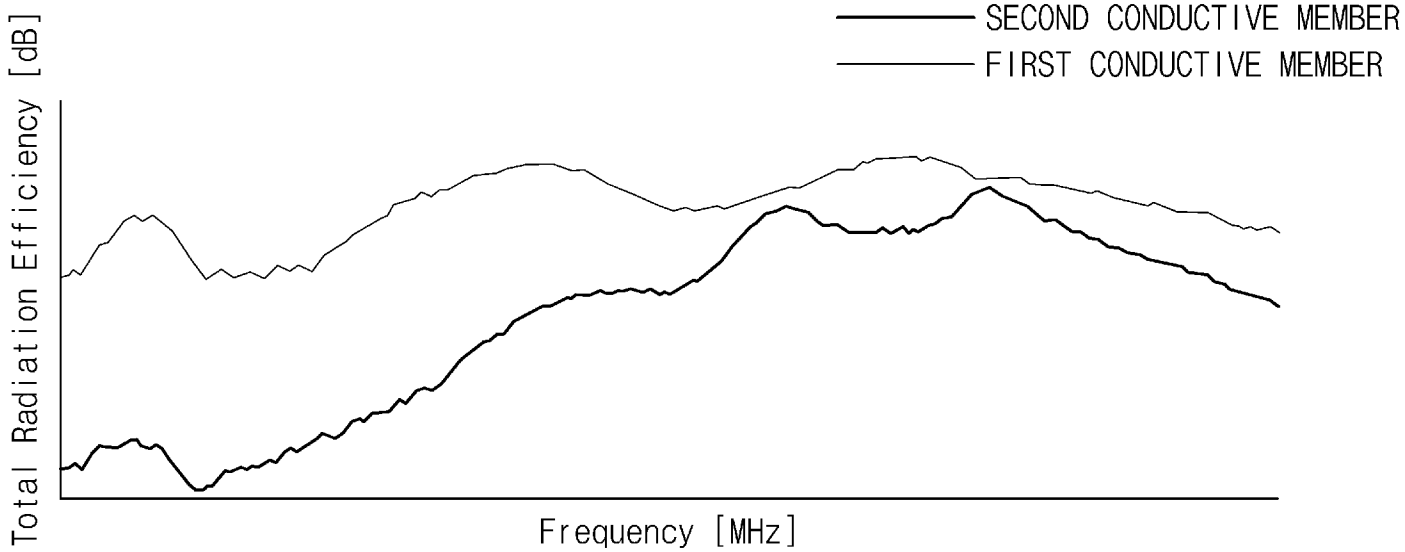
FIG. 4A illustrates a graph showing radiation efficiency of antennas, according to an embodiment of the present disclosure.
Figure 4B:
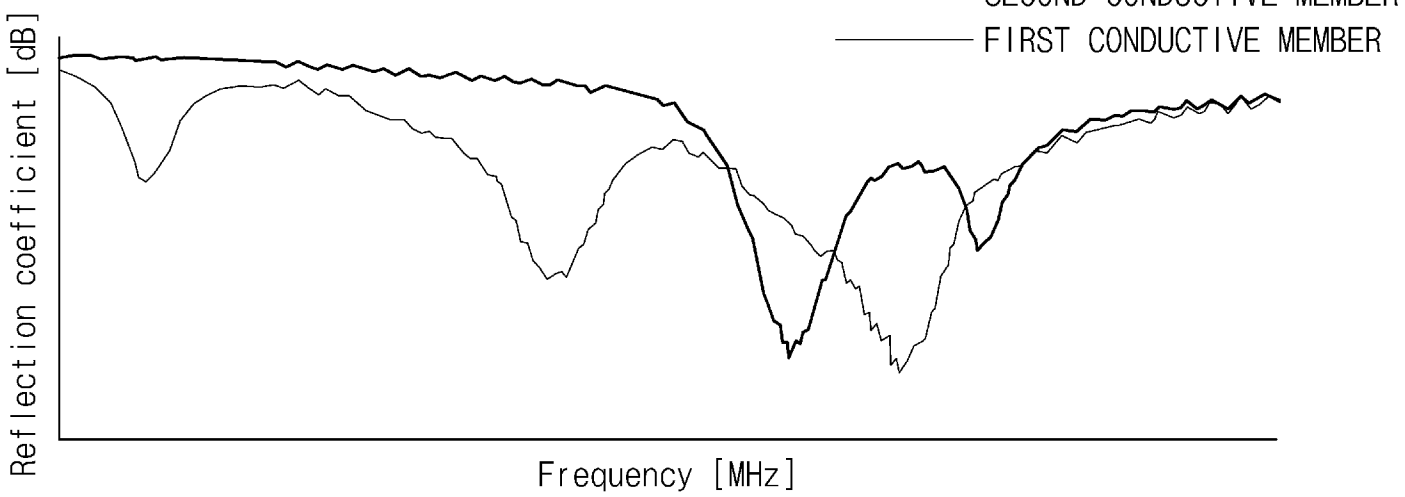
FIG. 4B illustrates a graph showing reflection coefficients of antennas, according to an embodiment of the present disclosure.

FIG. 3A illustrates a sectional view of an electronic device in which a first conductive member and a second conductive member are connected to a ground layer. FIG. 3B illustrates a sectional view of an electronic device in which a first conductive member and a second conductive member are connected to a metal layer. FIG. 4A illustrates a graph showing radiation efficiency of antennas. FIG. 4B illustrates a graph showing reflection coefficients of antennas. In this present disclosure, a description given with reference to FIG. 2 may be identically applied to elements that have the same reference numbers as the electronic device 100 described with reference to FIG. 2.

Referring to FIGS. 3A and 3B, the side housing 120 may include a first conductive member 120*a* and a second conductive member 120*c*. The first conductive member 120*a* may be disposed on a first surface facing a first direction. For example, the first conductive member 120*a* may be included in a first surface of a housing and part of a side surface of the housing. The first direction may be a direction in which a screen of the display 130 faces. The first conductive member 120*a* may correspond to an uppermost portion of the side housing 120 upon separating the side housing 120 in a direction perpendicular to the first direction. In FIGS. 3A and 3B, the first conductive member 120*a* is illustrated as being disposed at a location the same as or similar to a glass and the display 130. However, the location of the first conductive member 120*a* is not limited to what is shown in FIGS. 3A and 3B.

According to an embodiment of the present disclosure, a through hole may exist in the center of the first conductive member 120*a*. The glass may be disposed in the through hole, and the display 130 may display a screen through the glass. In FIGS. 3A and 3B, the first conductive member 120*a* is illustrated as being circular. However, the first conductive member 120*a* may have another shape.

According to an embodiment of the present disclosure, the second conductive member 120*c* may be disposed adjacent to a second surface facing a second direction. For example, the second conductive member 120*c* may form at least part of the side housing 120. The second direction may be opposite to the first direction. The second conductive member 120*c* may correspond to a lowermost portion of the side housing 120 upon separating the side housing 120 in the direction perpendicular to the first direction. In FIGS. 3A and 3B, the second conductive member 120*c* is illustrated as being disposed at a location the same as or similar to the PCB 160. However, the location of the second conductive member 120*c* is not limited to what is shown in FIGS. 3A and 3B.

According to an embodiment of the present disclosure, the through hole may exist in the center of the second conductive member 120*c*. The rear housing 170 may be disposed in the through hole to protect internal components. In FIGS. 3A and 3B, the second conductive member 120*c* is illustrated as being circular. However, the second conductive member 120*c* may have another shape.

According to an embodiment of the present disclosure, the side housing 120 may include a nonconductive member 120*b* disposed between the first surface and the second surface. The nonconductive member 120*b* may be disposed between the first conductive member 120*a* and the second conductive member 120*c*. In FIGS. 3A and 3B, the nonconductive member 120*b* is illustrated as being disposed at a location the same as or similar to the support member (bracket) 140 and the battery 150. However, the location of the nonconductive member 120*b* is not limited to what is shown in FIGS. 3A and 3B.

According to an embodiment of the present disclosure, the first conductive member 120*a* and the second conductive member 120*c* may be physically spaced apart from each other by the nonconductive member 120*b*.

A ground part may be electrically connected with at least one of the first conductive member 120*a* and the second conductive member 120*c*. The ground part may not be electrically connected with at least one of the first conductive member 120*a* or the second conductive member 120*c*. The ground part may include a ground layer 160*a* included in the PCB 160. Referring to FIG. 3A, the first conductive member 120*a* and the second conductive member 120*c* may be connected to the ground layer 160*a*. The ground part may include a metal layer 130*a* included in the display 130. For example, to block a signal generated by a display panel or a touch panel, a metal sheet, such as a copper (Cu) sheet, disposed under the display 130 may correspond to the metal layer 130*a*. Referring to FIG. 3B, the first conductive member 120*a* and the second conductive member 120*c* may be connected to the metal layer 130*a*.

In FIGS. 3A and 3B, the first conductive member 120*a* and the second conductive member 120*c* are illustrated as being connected to the ground layer 160*a* or the metal layer 130*a* at the same time. However, the first conductive member 120*a* and the second conductive member 120*c* may be respectively connected to the ground layer 160*a* and the metal layer 130*a*. For example, the first conductive member 120*a* may be connected to the metal layer 130*a*, and the second conductive member 120*c* may be connected to the ground layer 160*a*.

According to an embodiment of the present disclosure, the communication circuit may be disposed on the PCB 160. The communication circuit may be electrically connected with the first conductive member 120*a* and the second conductive member 120*c*. The communication circuit may feed the first conductive member 120*a* and the second conductive member 120*c*. The communication circuit may transmit/receive a signal through the first conductive member 120*a* and the second conductive member 120*c*. The signal transmitted/received through the first conductive member 120*a* and the second conductive member 120*c* may be a signal in an overlapping frequency band or may be a signal in another frequency band.

Referring to FIGS. 4A and 4B, the first conductive member 120*a* may transmit/receive a signal in a low band, a mid band, or a high band. The second conductive member 120*c* may transmit/receive a signal in the high band. The frequency at which the first conductive member 120*a* and the second conductive member 120*c* resonate may not be limited to a frequency illustrated in FIGS. 4A and 4B. For example, the first conductive member 120*a* and the second conductive member 120*c* may resonate at another frequency. A multi-band antenna may be implemented by separating the side housing 120 into areas and feeding the separated areas.

According to an embodiment of the present disclosure, the communication circuit may transmit/receive signals in different frequency bands through the first conductive member 120*a* and the second conductive member 120*c*. The communication circuit may perform carrier aggregation (CA) by using signals in different frequency bands. For example, the communication circuit may transmit/receive a signal in an 850 MHz band through the first conductive member 120*a* and may transmit/receive a signal of a 2.1 GHz band through the second conductive member 120*c*. For example, the communication circuit may perform inter-band CA by using a component carrier (CC) received in the 850 MHz band and a CC received in the 2.1 GHz band.

According to an embodiment of the present disclosure, the communication circuit may transmit/receive signals in overlapping frequency bands through the first conductive member 120*a* and the second conductive member 120*c*, respectively. The communication circuit may perform the CA by using a signal of an overlapping frequency band. For example, the communication circuit may transmit/receive a signal of a 2.6 GHz band through the first conductive member 120*a* and the second conductive member 120*c*. The communication circuit may perform intra-band CA by using signals of different CCs existing in the 2.6 GHz band.

According to an embodiment of the present disclosure, the communication circuit may receive a signal in a first frequency band through the first conductive member 120*a* and may receive a diversity signal in the first frequency band through the second conductive member 120*c*. Accordingly, the electronic device 100 may improve the reception performance of the first frequency band.

According to an embodiment of the present disclosure, the communication circuit may transmit/receive signals in various different frequency bands through the first conductive member 120*a* and the second conductive member 120*c*. For example, the communication circuit may implement a multi-input multi-output (MIMO) antenna through the first conductive member 120*a* and the second conductive member 120*c*.

An electronic device according to an embodiment of the present disclosure includes a housing that includes a first conductive member disposed on a first surface facing a first direction and a second conductive member disposed adjacent to a second surface facing a second direction opposite to the first direction, a nonconductive member that is located between the first conductive member and the second conductive member and forms part of the housing, a printed circuit board (PCB), a communication circuit that is disposed on the PCB and is electrically connected with the first conductive member and the second conductive member, and a ground part that is electrically connected with at least one of the first conductive member and the second conductive member. The communication circuit feeds the first conductive member and the second conductive member and transmits and receives a signal through the first conductive member and the second conductive member.

According to an embodiment of the present disclosure, the first conductive member and the second conductive member are spaced apart from each other by the nonconductive member.

According to an embodiment of the present disclosure, the electronic device further includes a display, and the ground part may include a metal layer attached to the display.

According to an embodiment of the present disclosure, the ground part includes a ground layer included in the PCB.

According to an embodiment of the present disclosure, a metal strap is connected to opposite ends of the second conductive member.

According to an embodiment of the present disclosure, the communication circuit transmits/receives signals in different frequency bands through the first conductive member and the second conductive member and performs carrier aggregation (CA) by using the signals in the different frequency bands.

According to an embodiment of the present disclosure, the communication circuit transmits/receives a signal in an overlapping frequency band through the first conductive member and the second conductive member and performs CA by using the signal in the overlapping frequency band.

According to an embodiment of the present disclosure, the communication circuit feeds a first point of the first conductive member, and the first conductive member is selectively connected with the ground part at a second point and a third point. The communication circuit transmits/receives a signal in a first frequency band by an electrical path formed through the first point and the second point and transmits/receives a signal in a second frequency band by an electrical path formed through the first point and the third point.

Figure 5:
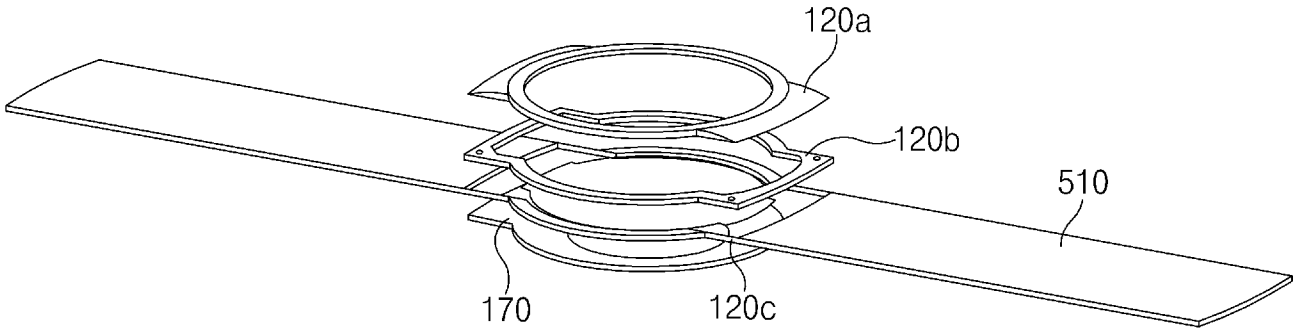
FIG. 5 illustrates an exploded perspective view of the electronic device connected to a metal strap, according to an embodiment of the present disclosure.

FIG. 5 illustrates an exploded perspective view of the electronic device 100 connected with a metal strap 510, according to an embodiment of the present disclosure.

Referring to FIG. 5, the electronic device 100 may correspond to a wearable electronic device mountable on a wrist.

According to an embodiment of the present disclosure, the metal strap 510 may be connected to opposite ends of the second conductive member 120*c*. The metal strap 510 may include a binding structure that allows the electronic device 100 to be mounted on a wrist. The metal strap 510 may include a nonconductive member such as silicon or the like for the purpose of insulation between the metal strap 510 and the skin of a user.

According to an embodiment of the present disclosure, the metal strap 510 may be connected to opposite ends of the second conductive member 120*c*. A first point of the first conductive member 120*a* may be connected with the communication circuit, and a second point of the first conductive member 120*a* may be connected to the second conductive member 120*c*. The first point and the second point may belong to an area included in the first conductive member 120*a*. The communication circuit may supply power through the first point of the first conductive member 120*a*. The communication circuit may transmit/receive signals in various frequency bands through the first conductive member 120*a*. When the communication circuit feeds the first conductive member 120*a*, the second conductive member 120*c* and the metal strap 510 may become a ground area.

According to an embodiment of the present disclosure, the communication circuit may feed the first conductive member 120*a* and the second conductive member 120*c*. The communication circuit may transmit/receive a signal through the first conductive member 120*a* and the second conductive member 120*c*. If the metal strap 510 is connected to the second conductive member 120*c* and the second conductive member 120*c* is connected to the first conductive member 120*a*, the communication circuit may feed the first conductive member 120*a* to transmit/receive a signal. When the communication circuit feeds the first conductive member 120*a*, the second conductive member 120*c* and the metal strap 510 may become a ground area.

Figure 6A:
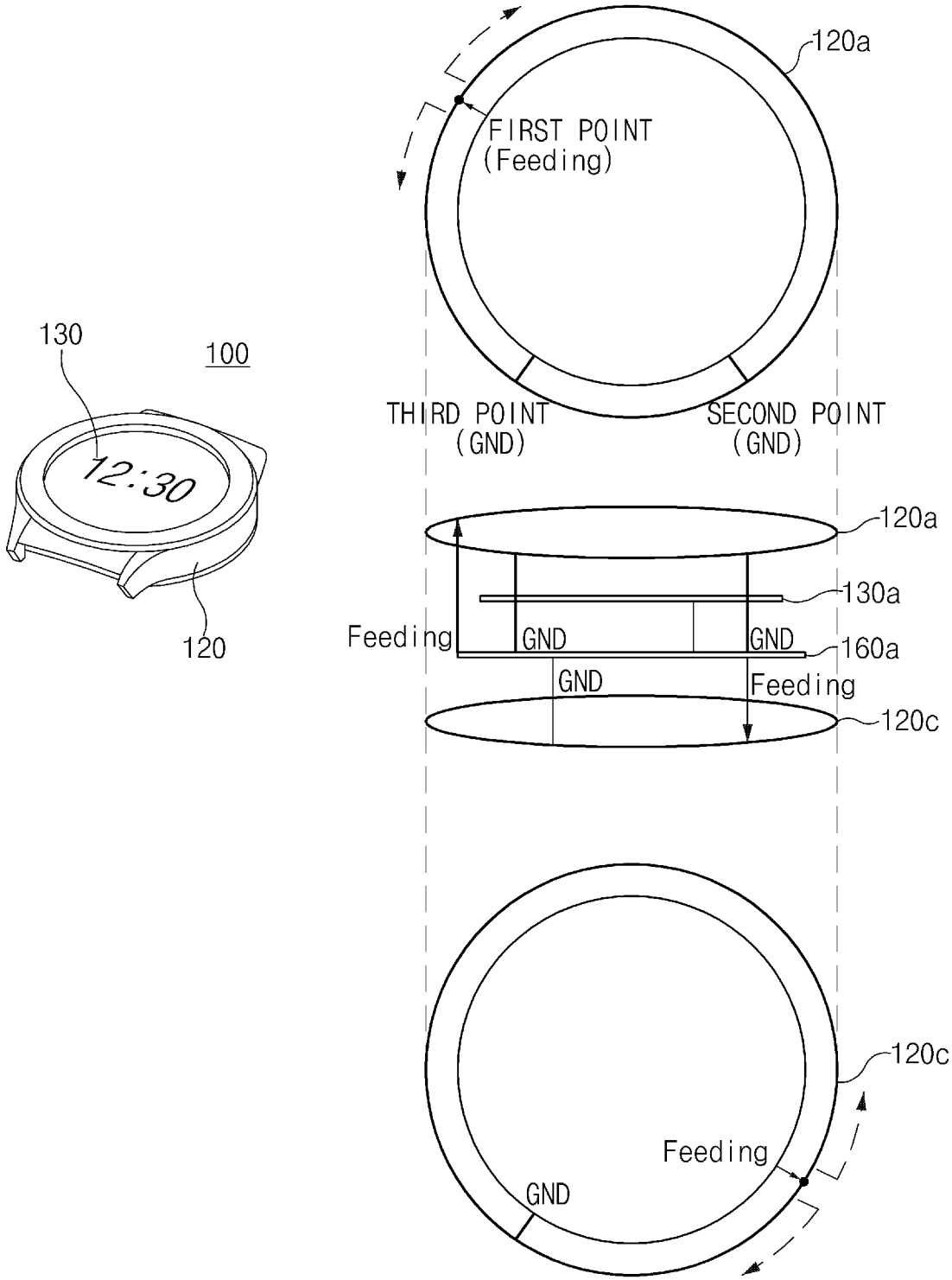
FIG. 6A illustrates an antenna connected to a ground layer, according to an embodiment of the present disclosure.
Figure 6B:
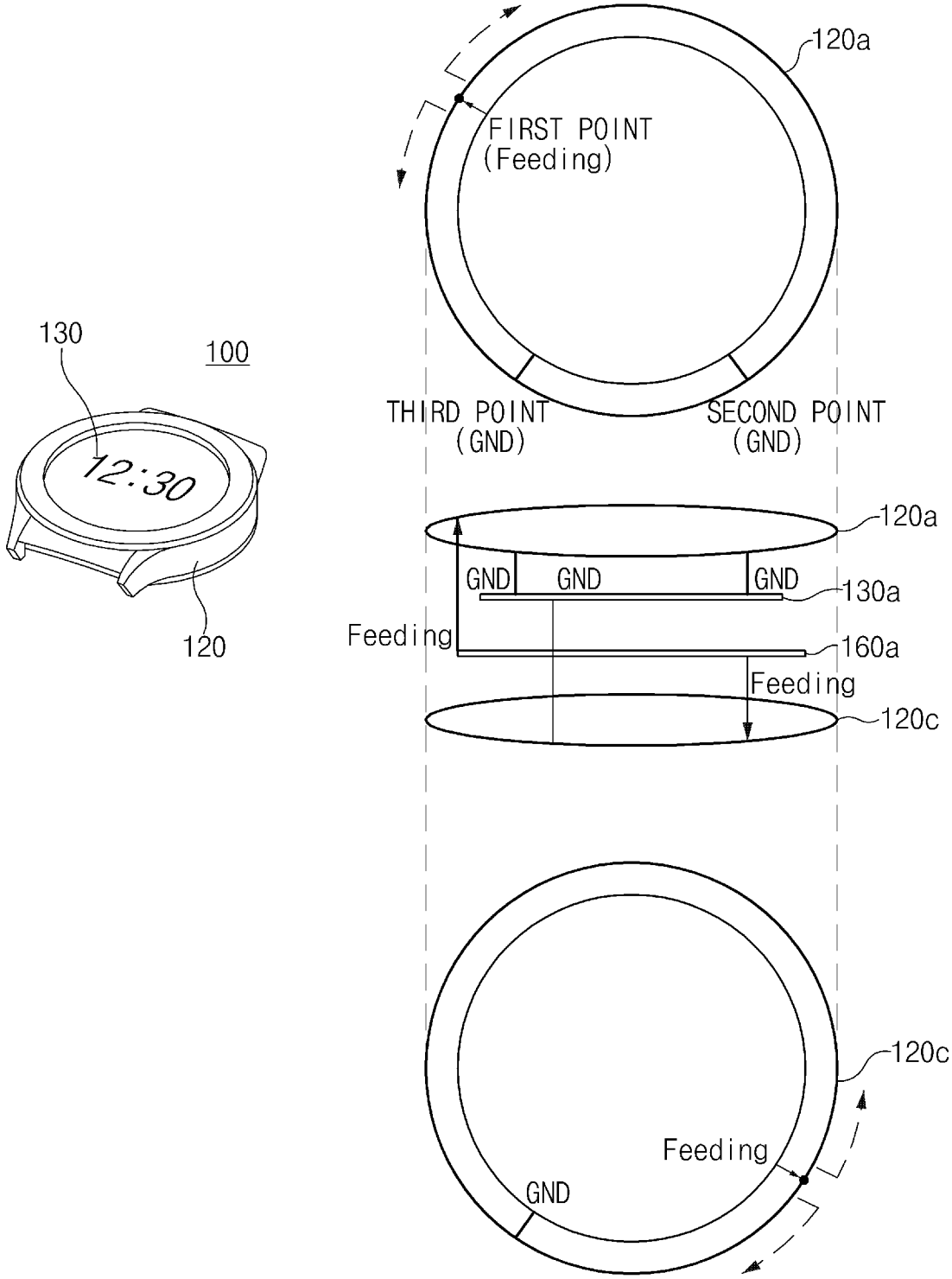
FIG. 6B illustrates the antenna connected to a metal layer, according to an embodiment of the present disclosure.

FIG. 6A illustrates an antenna connected to a ground layer, according to an embodiment of the present disclosure. FIG. 6B illustrates an antenna connected to a metal layer.

Referring to FIGS. 6A and 6B, the communication circuit may feed a first point of the first conductive member 120*a*. The first conductive member 120*a* may be selectively connected with a ground part at a second point and a third point. For example, if the second point is connected with the ground part, a connection of the third point with the ground part may be blocked. If a connection of the second point with the ground part is blocked, the third point may be connected with the ground part.

According to an embodiment of the present disclosure, if the second point is connected with the ground part, the communication circuit may transmit/receive a signal in the first frequency band by an electrical path formed through a first point and the second point. If the third point is connected with the ground part, the communication circuit may transmit/receive a signal in the second frequency band by an electrical path formed through the first point and the third point. The first frequency band and the second frequency band may be different from each other depending on a location of the second point and the third point. The first point and the third point may belong to an area included in the first conductive member 120*a*. However, the first point and the third point may not be limited to what is shown in FIGS. 6A and 6B.

According to an embodiment of the present disclosure, the communication circuit may perform the CA by using a signal in the first frequency band and a signal in the second frequency band. For example, if the first frequency band and the second frequency band coincide with each other, the communication circuit may perform intra-band CA. In another example, if the first frequency band and the second frequency band are different from each other, the communication circuit may perform inter-band CA.

According to an embodiment of the present disclosure, a ground part may include the ground layer 160*a* included in the PCB 160. Referring to FIG. 6A, the first conductive member 120*a* and the second conductive member 120*c* may be connected to the ground layer 160*a*. The ground part may include the metal layer 130*a* attached to the display 130. Referring to FIG. 6B, the first conductive member 120*a* and the second conductive member 120*c* may be connected to the metal layer 130*a*.

In FIGS. 6A and 6B, the first conductive member 120*a* and the second conductive member 120*c* are illustrated as being connected to the ground layer 160*a* or the metal layer 130*a* at the same time. However, the first conductive member 120*a* and the second conductive member 120*c* may be respectively connected to the ground layer 160*a* and the metal layer 130*a*. For example, the first conductive member 120*a* may be connected to the metal layer 130*a*, and the second conductive member 120*c* may be connected to the ground layer 160*a*.

According to an embodiment of the present disclosure, the communication circuit may transmit/receive a signal through the second conductive member 120*c*. The second conductive member 120*c* may be connected with the communication circuit and the ground part, and the communication circuit may feed the second conductive member 120*c*. A signal that the communication circuit transmits/receives through the second conductive member 120*c* may be the same as or different from a signal in the first frequency band or the second frequency band.

An electronic device according to an embodiment of the present disclosure includes a housing that includes a conductive member disposed on a first surface facing a first direction and a ground part connected with the conductive member and disposed adjacent to a second surface facing a second direction opposite to the first direction, a printed circuit board (PCB), and a communication circuit that is disposed on the PCB and is electrically connected with the conductive member. The communication circuit feeds a first point of the conductive member, the conductive member is selectively connected with the ground part at a second point and a third point, and the communication circuit transmits/receives a signal in a first frequency band by an electrical path formed through the first point and the second point and transmits/receives a signal in a second frequency band by an electrical path formed through the first point and the third point.

According to an embodiment of the present disclosure, a metal strap is connected to opposite ends of the ground part.

According to an embodiment of the present disclosure, the electronic device further includes an antenna radiator interposed between the conductive member and the ground part and electrically connected with the communication circuit and the ground part, and the communication circuit feeds the antenna radiator to transmit/receive a signal in a third frequency band.

According to an embodiment of the present disclosure, the third frequency band is a frequency band of near field communication (NFC).

According to an embodiment of the present disclosure, the electronic device further includes a display, and the ground part includes a metal layer attached to the display.

According to an embodiment of the present disclosure, the ground part includes a ground layer included in the PCB.

Figure 7A:
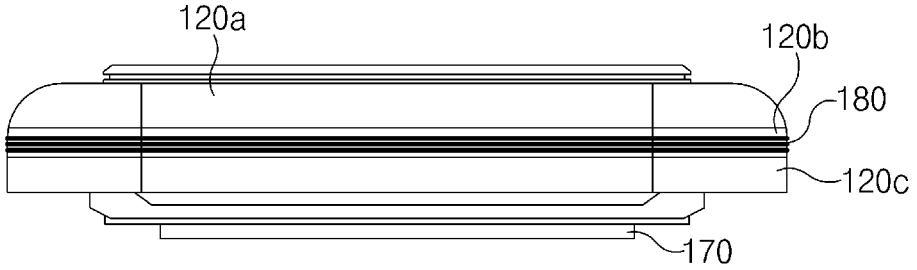
FIG. 7A illustrates the electronic device in which an antenna radiator is disposed between nonconductive members, according to an embodiment of the present disclosure.
Figure 7B:
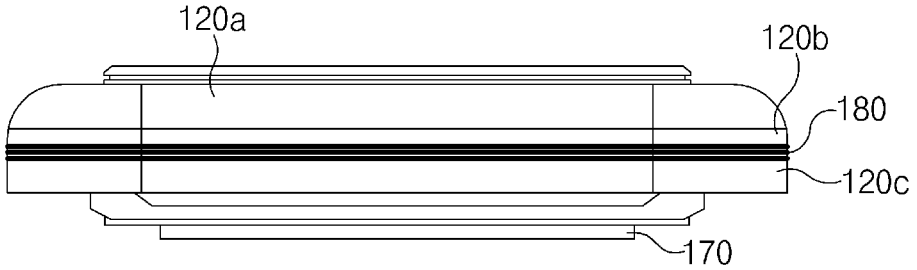
FIG. 7B illustrates the electronic device in which the antenna radiator is disposed between the nonconductive member and the second conductive member, according to an embodiment of the present disclosure.

FIG. 7A illustrates an electronic device in which an antenna radiator is disposed between a nonconductive members, according to an embodiment of the present disclosure. FIG. 7B illustrates an electronic device in which an antenna radiator is disposed between a nonconductive member and a second conductive member.

Referring to FIGS. 7A and 7B, the side housing 120 may include the first conductive member 120*a*, the second conductive member 120*c*, and the nonconductive member 120*b* that electrically spaces the first conductive member 120*a* and the second conductive member 120*c* apart from each other. The nonconductive member 120*b* may be interposed between the first conductive member 120*a* and the second conductive member 120*c* and may be formed of the nonconductive member described with reference to FIGS. 3A and 3B.

Referring to FIGS. 7A and 7B, a radiator 180 of a local communication antenna (e.g., a near field communication (NFC) antenna, a magnetic secure transmission (MST) antenna, and the like) may be disposed between the nonconductive members 120*b*. For example, a conductive material for receiving a signal (e.g., 13.56 MHz) in an NFC frequency band may be patterned in the nonconductive member 120*b*. The conductive material may be disposed to wind the nonconductive member 120*b* helically and may be connected with a PCB (e.g., a communication circuit or an NFC module) within the side housing 120 at one end thereof. The conductive material may be patterned within the nonconductive member 120*b* so as not to be exposed to the outside. A conductive material for magnetic secure transmission may be patterned in the nonconductive member 120*b*.

According to an embodiment of the present disclosure, the first conductive member 120*a*, the second conductive member 120*c*, or the antenna radiator 180 may be electrically connected with the communication circuit and the ground part. The communication circuit may feed the first conductive member 120*a* to transmit/receive a signal in the first frequency band. The communication circuit may feed the antenna radiator 180 to transmit/receive a signal in the second frequency band. The first frequency band and the second frequency band may be the same as or different from each other.

For example, the first frequency band may be a high frequency band of 2.1 GHz, and the second frequency band may be in an NFC frequency band of 13.56 MHz. The communication circuit may communicate in the high frequency band through the first conductive member 120*a* and may perform NFC tagging through the antenna radiator 180.

An electronic device according to an embodiment of the present disclosure includes a housing that includes a first conductive member disposed on a first surface facing a first direction, a second conductive member disposed adjacent to a second surface facing a second direction opposite to the first direction, and a nonconductive member spacing the first conductive member and the second conductive member apart from each other, a printed circuit board (PCB), a communication circuit that is disposed on the PCB and is electrically connected with the first conductive member, a ground part electrically connected with the first conductive member, and an antenna radiator that is disposed on the nonconductive member and is electrically connected with the communication circuit and the ground part. The communication circuit feeds the first conductive member to transmit/receive a signal in a first frequency band and feeds the antenna radiator to transmit/receive a signal in a second frequency band.

According to an embodiment of the present disclosure, the second frequency band is in a frequency band of near field communication (NFC).

According to an embodiment of the present disclosure, the second conductive member is electrically connected with the communication circuit and the ground part, and the communication circuit feeds the second conductive member to transmit/receive a signal in a third frequency band.

According to an embodiment of the present disclosure, the communication circuit performs CA by using the signal in the first frequency band and the signal in the third frequency band.

According to an embodiment of the present disclosure, a metal strap is connected to opposite ends of the second conductive member.

According to an embodiment of the present disclosure, the communication circuit feeds a first point of the first conductive member, and the first conductive member is selectively connected with the ground part at a second point and a third point. The communication circuit transmits/receives a first signal by an electrical path formed through the first point and the second point and transmits/receives a second signal by an electrical path formed through the first point and the third point.

Figure 8:
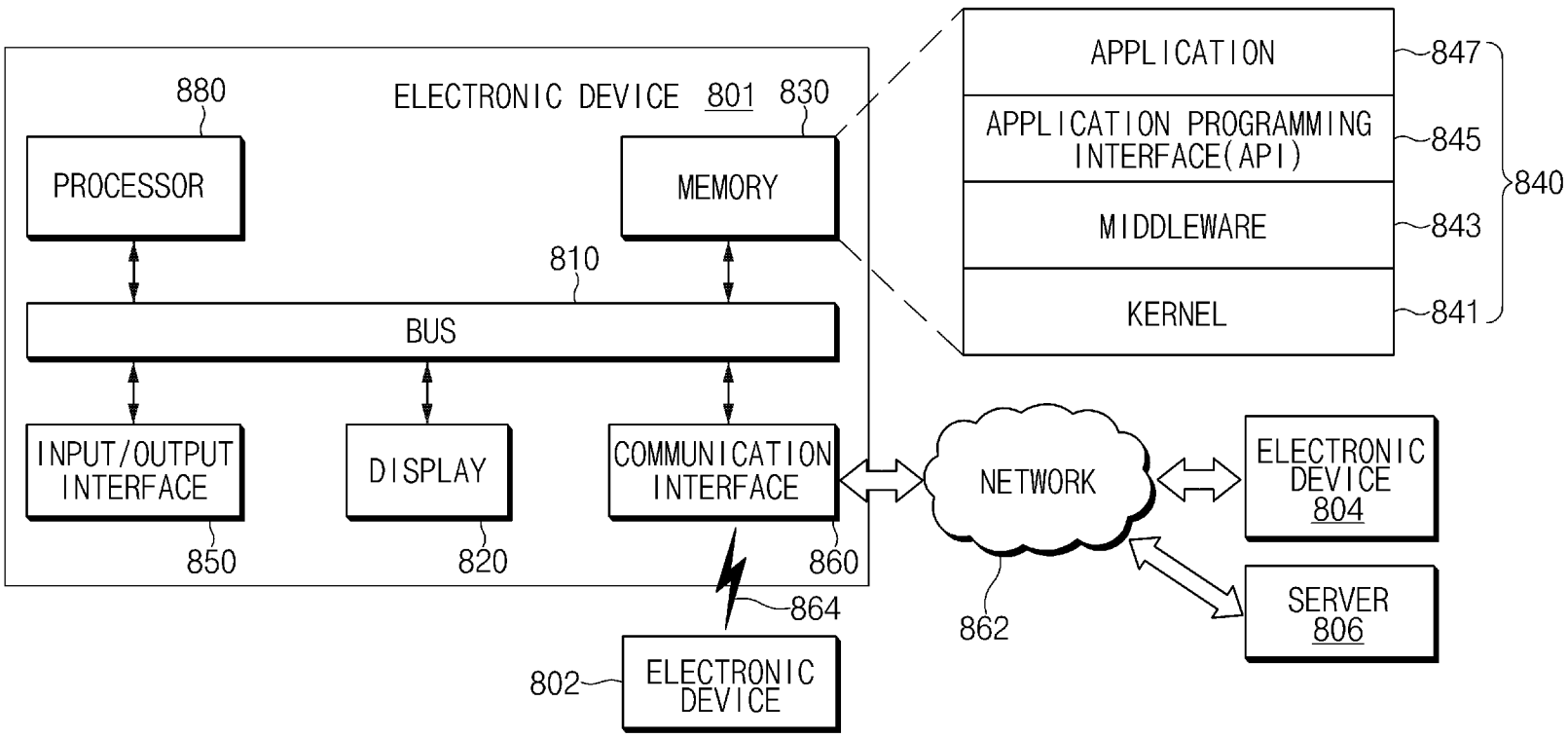
FIG. 8 illustrates the electronic device in a network environment, according to an embodiment of the present disclosure.

FIG. 8 illustrates an electronic device in a network environment, according to an embodiment of the present disclosure.

Referring to FIG. 8, according to an embodiment of the present disclosure, an electronic device 801, a first electronic device 802, a second electronic device 804, and a server 806 may be connected with each other over a network 862 or local wireless communication 864. The electronic device 801 may include a bus 810, a processor 880, a memory 830, an input/output interface 850, a display 820, and a communication interface 860. The electronic device 801 may not include at least one of the above described elements or may further include other element(s).

For example, the bus 810 may interconnect the above described elements 810 to 860 and may include a circuit for conveying communications (e.g., a control message and/or data) among the above described elements.

The processor 880 may include one or more of a CPU, AP, and a CP. For example, the processor 880 may perform an arithmetic operation or data processing associated with control and/or communication of at least other elements of the electronic device 801.

The memory 830 may include a volatile and/or nonvolatile memory. For example, the memory 830 may store instructions or data associated with at least one other element(s) of the electronic device 801. The memory 830 may store software and/or a program 840. The program 840 may include a kernel 841, a middleware 843, an application programming interface (API) 845, and/or an application program (or "an application") 847. At least a part of the kernel 841, the middleware 843, and the API 845 may be referred to as an "operating system (OS)".

For example, the kernel 841 may control and manage system resources (e.g., the bus 810, the processor 880, the memory 830, and the like) that are used to execute operations and functions of other programs (e.g., the middleware 843, the API 845, and the application program 847). Furthermore, the kernel 841 may provide an interface that allows the middleware 843, the API 845, and the application program 847 to access discrete elements of the electronic device 801 so as to control or manage system resources.

The middleware 843 may perform a mediation role such that the API 845 and the application program 847 communicates with the kernel 841 to exchange data.

Furthermore, the middleware 843 may process one or more task requests received from the application program 847 according to a priority. For example, the middleware 843 may assign the priority, which makes it possible to use a system resource (e.g., the bus 810, the processor 880, the memory 830, and the like) of the electronic device 801, to the application program 847. For example, the middleware 843 may process the one or more task requests according to the priority assigned to the task, which makes it possible to perform scheduling and load balancing on the one or more task requests.

The API 845 may be an interface through which the application program 847 controls a function provided by the kernel 841 or the middleware 843, and may include an interface or function (e.g., an instruction) for a file control, a window control, image processing, a character control, and the like.

The input/output interface 850 may be an interface which transmits an instruction or data input from a user or another external device, to other element(s) of the electronic device 801. Furthermore, the input/output interface 850 may output an instruction and data, received from other element(s) of the electronic device 801, to a user or another external device.

The display 820 may include a liquid crystal display (LCD), a light-emitting diode (LED) display, an organic LED (OLED) display, a microelectromechanical systems (MEMS) display, and an electronic paper display. The display 820 may display various contents (e.g., a text, an image, a video, an icon, a symbol, and the like) to a user. The display 820 may include a touch screen and may receive a touch, gesture, proximity, and hovering input using an electronic pen or a part of a user's body.

The communication interface 860 may establish communication between the electronic device 801 and an external device (e.g., the first electronic device 802, the second electronic device 804, and the server 806). For example, the communication interface 860 may be connected to the network 862 over wireless communication or wired communication to communicate with the external device (e.g., the second electronic device 804 or the server 806).

The wireless communication may use long-term evolution (LTE), LTE advanced (LTE-A), code division multiple access (CDMA), wideband CDMA (WCDMA), universal mobile telecommunications system (UMTS), wireless broadband (WiBro), global system for mobile communications (GSM), and the like, as a cellular communication protocol. Furthermore, the wireless communication may include the local wireless communication 864. The local wireless communication 864 may include wireless fidelity (Wi-Fi), Bluetooth®, NFC, MST, a global navigation satellite system (GNSS), and the like.

The MST may generate a pulse in response to transmission data using an electromagnetic signal, and the pulse may generate a magnetic field signal. The electronic device 801 may transfer the magnetic field signal to a POS device, and the POS device may detect the magnetic field signal using a MST reader. The POS device may recover the data by converting the detected magnetic field signal to an electrical signal.

The GNSS may include a global positioning system (GPS), a global navigation satellite system (Glonass), a Beidou navigation satellite system (Beidou), and a European global satellite-based navigation system (Galileo) based on an available region, a bandwidth, and the like. In this disclosure, "GPS" and "GNSS" may be interchangeably used. The wired communication may include a universal serial bus (USB), a high definition multimedia interface (HDMI), a recommended standard-232 (RS-232), a plain old telephone service (POTS), and the like. The network 862 may include telecommunications networks, for example, a computer network (e.g., LAN or WAN), an Internet, and a telephone network.

Each of the first and second electronic devices 802 and 804 may be a device of which the type is different from or the same as that of the electronic device 801. The server 806 may include a group of one or more servers. All or a portion of operations that the electronic device 801 will perform may be executed by another or a plurality of electronic devices (e.g., the first electronic device 802, the second electronic device 804 and the server 806). In the case where the electronic device 801 executes any function or service automatically or in response to a request, the electronic device 801 may not perform the function or the service internally, but, alternatively, may request at least a portion of a function associated with the electronic device 801 from other electronic device(s) (e.g., the electronic device 802, electronic device 804, and the server 806). The other electronic device may execute the requested function or additional function and may transmit the execution result to the electronic device 801. The electronic device 801 may provide the requested function or service using the received result or may additionally process the received result to provide the requested function or service. To this end, cloud computing, distributed computing, and client-server computing may be used.

Figure 9:
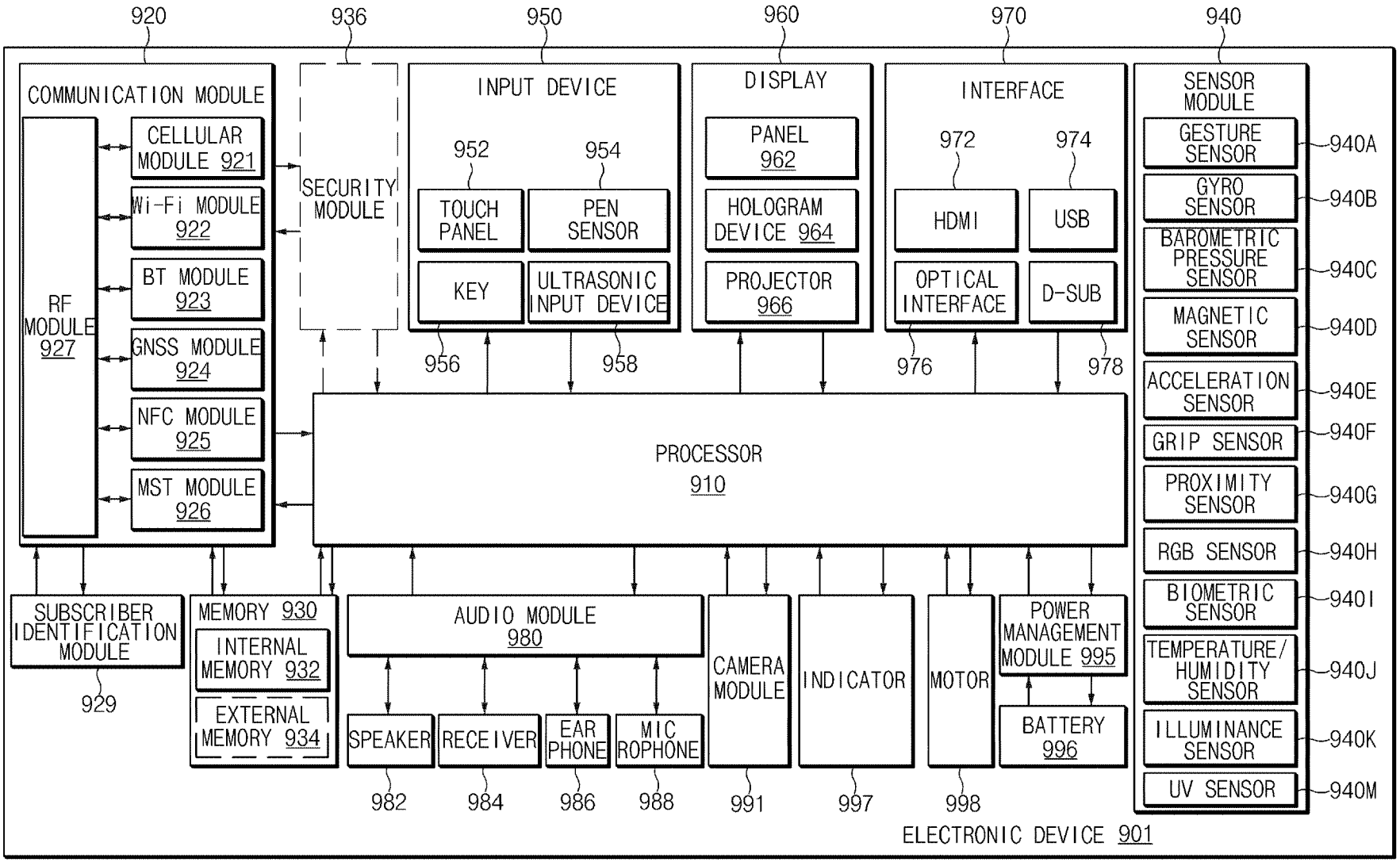
FIG. 9 illustrates a block diagram of the electronic device according to an embodiment of the present disclosure.

FIG. 9 illustrates a block diagram of an electronic device, according to an embodiment of the present disclosure.

Referring to FIG. 9, an electronic device 901 may include all or a part of the electronic device 801 illustrated in FIG. 8. The electronic device 901 may include one or more processors (e.g., an AP) 910, a communication module 920, a subscriber identification module (SIM) 929, a memory 930, a sensor module 940, an input device 950, a display 960, an interface 970, an audio module 980, a camera module 991, a power management module 995, a battery 996, an indicator 997, and a motor 998.

The processor 910 may drive an OS and an application to control a plurality of hardware and software elements connected to the processor 910 and may process and compute a variety of data. For example, the processor 910 may be implemented with a System on Chip (SoC). The processor 910 may further include a graphic processing unit (GPU) and/or an image signal processor. The processor 910 may include part (e.g., a cellular module 921) of elements illustrated in FIG. 9. The processor 910 may load an instruction and data, which is received from other element(s) (e.g., a nonvolatile memory), into a volatile memory and process the loaded instruction or data. The processor 910 may store a variety of data in the nonvolatile memory.

The communication module 920 may be configured the same as or similar to the communication interface 870 of FIG. 8. The communication module 920 may include the cellular module 921, a Wi-Fi module 922, a Bluetooth (BT) module 923, a GNSS module 924 (e.g., a GPS module, a Glonass module, a Beidou module, and a Galileo module), NFC module 925, an MST module 926 and a radio frequency (RF) module 927.

The cellular module 921 may provide voice communication, video communication, a character service, an Internet service, and the like over a communication network. The cellular module 921 may perform discrimination and authentication of the electronic device 901 within a communication network by using the SIM (e.g., a SIM card) 929. The cellular module 921 may perform a portion of functions that the processor 910 provides. The cellular module 921 may include a CP.

Each of the Wi-Fi module 922, the BT module 923, the GNSS module 924, the NFC module 925, and the MST module 926 may include a processor for processing data exchanged through a corresponding module. Part (e.g., two or more) of the cellular module 921, the Wi-Fi module 922, the BT module 923, the GNSS module 924, the NFC module 925, and the MST module 926 may be included within one Integrated Circuit (IC) or an IC package.

The RF module 927 may transmit and receive a communication signal (e.g., an RF signal). For example, the RF module 927 may include a transceiver, a power amplifier module (PAM), a frequency filter, a low noise amplifier (LNA), an antenna, and the like. The cellular module 921, the Wi-Fi module 922, the BT module 923, the GNSS module 924, the NFC module 925, and the MST module 926 may transmit and receive an RF signal through a separate RF module.

The SIM 929 may include a card and/or embedded SIM that includes a SIM and may include unique identify information (e.g., integrated circuit card identifier (ICCID)) and subscriber information (e.g., international mobile subscriber identity (IMSI)).

The memory 930 may include an internal memory 932 and an external memory 934. For example, the internal memory 932 may include a volatile memory (e.g., a dynamic random access memory (DRAM), a static RAM (SRAM), a synchronous DRAM (SDRAM), and the like), a nonvolatile memory (e.g., a one-time programmable read only memory (OTPROM), a programmable ROM (PROM), an erasable and programmable ROM (EPROM), an electrically erasable and programmable ROM (EEPROM), a mask ROM, a flash ROM, a flash memory (e.g., a NAND flash memory or a NOR flash memory), and the like), a hard drive, and a solid state drive (SSD).

The external memory 934 may further include a flash drive such as compact flash (CF), secure digital (SD), micro secure digital (Micro-SD), mini secure digital (Mini-SD), extreme digital (xD), a multimedia card (MMC), a memory stick, and the like. The external memory 934 may be operatively and/or physically connected to the electronic device 901 through various interfaces.

A security module 936 may be a module that includes a storage space of which a security level is higher than that of the memory 930 and may be a circuit that guarantees safe data storage and a protected execution environment. The security module 936 may be implemented with a separate circuit and may include a separate processor. For example, the security module 936 may be in a smart chip or a secure digital (SD) card, which is removable, or may include an embedded secure element (eSE) embedded in a fixed chip of the electronic device 901. Furthermore, the security module 936 may operate based on an OS that is different from the OS of the electronic device 901. For example, the security module 936 may operate based on java card open platform (JCOP) OS.

The sensor module 940 may measure a physical quantity and may detect an operation state of the electronic device 901. The sensor module 940 may convert the measured or detected information to an electric signal. For example, the sensor module 940 may include a gesture sensor 940A, a gyro sensor 940B, a barometric pressure sensor 940C, a magnetic sensor 940D, an acceleration sensor 940E, a grip sensor 940F, the proximity sensor 940G, a color sensor 940H (e.g., red, green, blue (RGB) sensor), a biometric sensor 940I, a temperature/humidity sensor 940J, an illuminance sensor 940K, and an UV sensor 940M. Although not illustrated, the sensor module 940 may further include an E-nose sensor, an electromyography (EMG) sensor, an electroencephalogram (EEG) sensor, an electrocardiogram (ECG) sensor, an infrared (IR) sensor, an iris sensor, and/or a fingerprint sensor. The sensor module 940 may further include a control circuit for controlling sensors included therein. The electronic device 901 may further include a processor that is a part of the processor 910 or independent of the processor 910 and is configured to control the sensor module 940. The processor may control the sensor module 940 while the processor 910 remains at a sleep state.

The input device 950 may include a touch panel 952, a (digital) pen sensor 954, a key 956, and an ultrasonic input unit 958. For example, the touch panel 952 may use capacitive, resistive, infrared and ultrasonic detecting methods. Also, the touch panel 952 may further include a control circuit. The touch panel 952 may further include a tactile layer to provide a tactile reaction to a user.

The (digital) pen sensor 954 may be a part of a touch panel and may include an additional sheet for recognition. The key 956 may include a physical button, an optical key, and a keypad. The ultrasonic input device 958 may detect (or sense) an ultrasonic signal, which is generated from an input device, through a microphone 988 and may check data corresponding to the detected ultrasonic signal.

The display 960 may include a panel 962, a hologram device 964, and a projector 966. The panel 962 may be the same as or similar to the display 860 illustrated in FIG. 8. The panel 962 may be implemented to be flexible, transparent and wearable. The panel 962 and the touch panel 952 may be integrated into a single module. The hologram device 964 may display a stereoscopic image in a space using a light interference phenomenon. The projector 966 may project light onto a screen to display an image. For example, the screen may be arranged in the inside or the outside of the electronic device 901. The display 960 may further include a control circuit for controlling the panel 962, the hologram device 964, and the projector 966.

The interface 970 may include an HDMI 972, USB 974, an optical interface 976, or a D-subminiature (D-sub) 978. The interface 970 may be included in the communication interface 870 illustrated in FIG. 8. Additionally, the interface 970 may include a mobile high definition link (MHL) interface, a SD card/multi-media card (MMC) interface, and an Infrared Data Association (IrDA) standard interface.

The audio module 980 may convert a sound and an electric signal in dual directions. The audio module 980 may be included the input/output interface 850 illustrated in FIG. 8. The audio module 980 may process sound information that is input or output through a speaker 982, a receiver 984, an earphone 986, and the microphone 988.

The camera module 991 may shoot a still image or a video. The camera module 991 may include at least one or more image sensors (e.g., a front sensor or a rear sensor), a lens, an image signal processor (ISP), and a flash (e.g., an LED or a xenon lamp).

The power management module 995 may manage power of the electronic device 901. A power management integrated circuit (PMIC), a charger IC, and a battery gauge may be included in the power management module 995. The PMIC may have a wired charging method and/or a wireless charging method. The wireless charging method may include a magnetic resonance method, a magnetic induction method and an electromagnetic method and may further include an additional circuit, for example, a coil loop, a resonant circuit, a rectifier, and the like. The battery gauge may measure the remaining capacity of the battery 996 and a voltage, current and temperature thereof while the battery is charged. The battery 996 may include a rechargeable battery and/or a solar battery.

The indicator 997 may display a specific state of the electronic device 901 or a part thereof (e.g., the processor 910), such as a booting state, a message state, a charging state, and the like. The motor 998 may convert an electrical signal into a mechanical vibration and may generate the following effects: vibration, haptic, and the like. A processing device (e.g., a GPU) for supporting a mobile TV may be included in the electronic device 901. The processing device for supporting the mobile TV may process media data according to the standards of digital multimedia broadcasting (DMB), digital video broadcasting (DVB), MediaFLO™, and the like.

Each of the above mentioned elements of the electronic device according to various embodiments of the present disclosure may be configured with one or more components, and the names of the elements may be changed according to the type of the electronic device. The electronic device may include the above mentioned elements, and some elements may be omitted or other additional elements may be added. Furthermore, some of the elements of the electronic device according to various embodiments may be combined with each other so as to form one entity, so that the functions of the elements may be performed in the same manner as before the combination.

Figure 10:
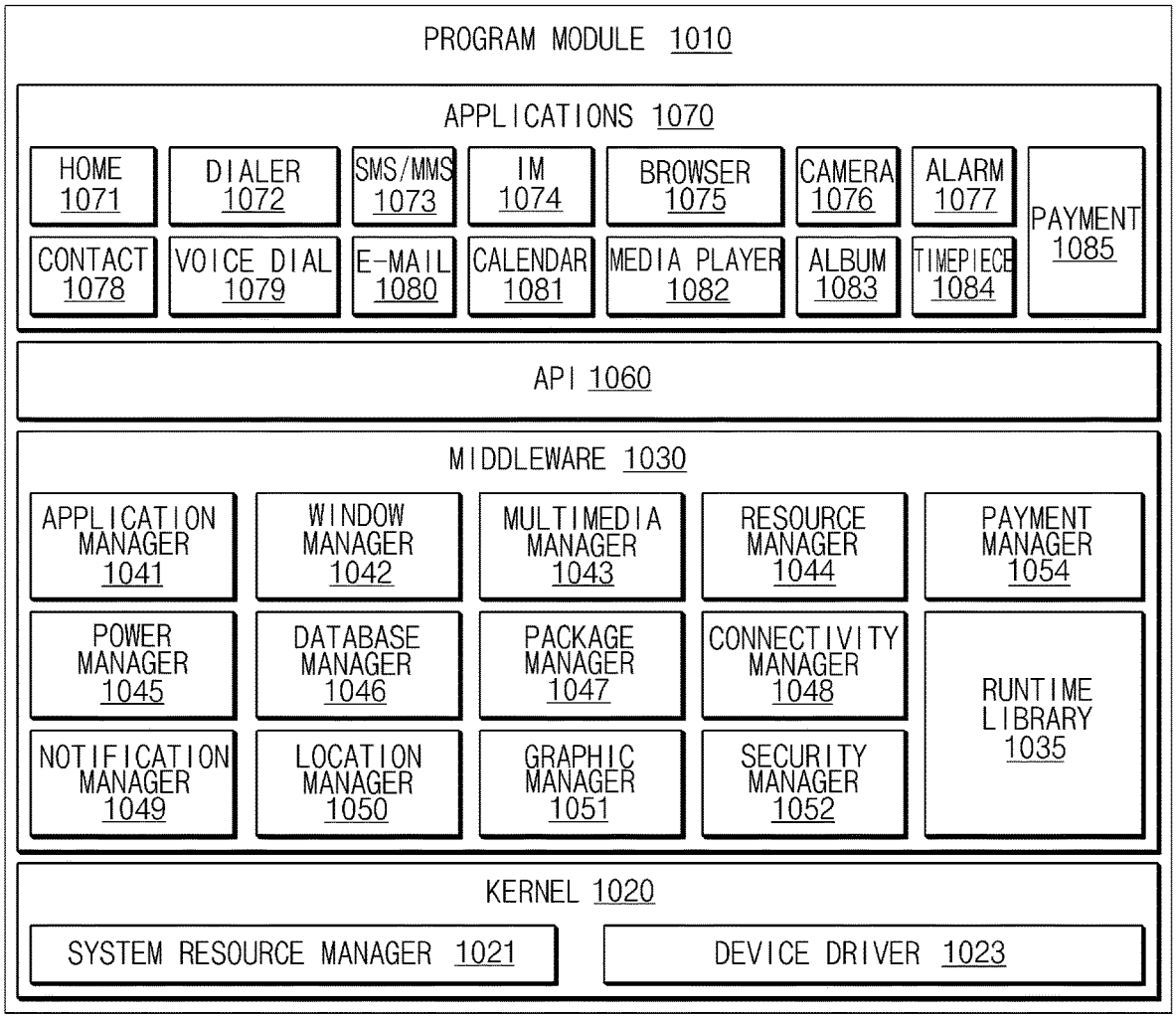
FIG. 10 illustrates a block diagram of a program module according to an embodiment of the present disclosure.

FIG. 10 illustrates a block diagram of a program module, according to various embodiments of the present invention.

According to an embodiment of the present disclosure, a program module 1010 (e.g., the program 840) may include an OS to control the resources associated with an electronic device 801, and/or applications executed on the OS. The OS may be Android®, iOS, Windows®, Symbian®, Tizen®, and the like.

The program module 1010 may include a kernel 1020, a middleware 1030, an API 1060, and/or an application 1070. The program module 1010 may be preloaded on an electronic device or may be downloadable from an external electronic device (e.g., the first electronic device 802, the second electronic device 804, the server 806, and the like).

The kernel 1020 may include a system resource manager 1021 and a device driver 1023. The system resource manager 1021 may control, allocate, and retrieve system resources. The system resource manager 1021 may include a process managing unit, a memory managing unit, a file system managing unit, and the like. The device driver 1023 may include a display driver, a camera driver, a Bluetooth driver, a shared memory driver, a USB driver, a keypad driver, a Wi-Fi driver, an audio driver, and an inter-process communication (IPC) driver.

The middleware 1030 may provide a function that the application 1070 needs in common, or may provide diverse functions to the application 1070 through the API 1060 to allow the application 1070 to efficiently use limited system resources of the electronic device. The middleware 1030 may include a runtime library 1035, an application manager 1041, a window manager 1042, a multimedia manager 1043, a resource manager 1044, a power manager 1045, a database manager 1046, a package manager 1047, a connectivity manager 1048, a notification manager 1049, a location manager 1050, a graphic manager 1051, a security manager 1052, and a payment manager 1054.

The runtime library 1035 may include a library module that is used by a compiler to add a new function through a programming language while the application 1070 is being executed. The runtime library 1035 may perform input/output management, memory management, and capacities about arithmetic functions.

The application manager 1041 may manage a life cycle of one application of the application 1070. The window manager 1042 may manage a graphic user interface (GUI) resource that is used in a screen. The multimedia manager 1043 may identify a format necessary for playing diverse media files, and may perform encoding or decoding of media files by using a codec suitable for the format. The resource manager 1044 may manage resources such as a storage space, memory, and source code of one application of the application 1070.

The power manager 1045 may operate with a basic input/output system (BIOS) to manage a battery and power, and may provide power information for an operation of an electronic device. The database manager 1046 may generate, search for, and modify database(s) used in at least one application of the application 1070. The package manager 1047 may install or update an application that is distributed in the form of package file.

The connectivity manager 1048 may manage wireless connection such as Wi-Fi or Bluetooth. The notification manager 1049 may display and notify an event such as arrival message, appointment, and proximity notification in a mode that does not disturb a user. The location manager 1050 may manage location information about an electronic device. The graphic manager 1051 may manage a graphic effect that is provided to a user, and manage a user interface relevant thereto. The security manager 1052 may provide a general security function necessary for system security, user authentication, and the like. In the case where an electronic device 801 includes a telephony function, the middleware 1030 may further include a telephony manager for managing a voice or video call function of the electronic device.

The middleware 1030 may include a middleware module that combines diverse functions of the above described elements. The middleware 1030 may provide a module specialized to each OS version to provide differentiated functions. Additionally, the middleware 1030 may dynamically remove a part of the preexisting elements and may add new elements thereto.

The API 1060 (e.g., the API 845) may be a set of programming functions and may be provided with a configuration that is variable depending on an OS. For example, in the case where an OS is Android® or iOS, it may provide one API set per platform. In the case where an OS is Tizen®, it may provide two or more API sets per platform.

The application 1070 may include one or more applications capable of providing functions for a home 1071, a dialer 1072, an SMS/MMS 1073, an instant message (IM) 1074, a browser 1075, a camera 1076, an alarm 1077, a contact 1078, a voice dial 1079, an e-mail 1080, a calendar 1081, a media player 1082, an album 1083, a timepiece 1084, a payment 1085, health care (e.g., measuring an exercise quantity, blood sugar level, and the like) and offering of environment information (e.g., information of barometric pressure, humidity, temperature, and the like).

According to an embodiment of the present disclosure, the application 1070 may include an information exchanging application to support information exchange between an electronic device 801 and an external electronic device. The information exchanging application may include a notification relay application for transmitting specific information to an external electronic device, and a device management application for managing the external electronic device.

The notification relay application may include a function of transmitting notification information, which arise from other applications (e.g., applications for SMS/MMS, e-mail, health care, or environmental information), to an external electronic device. Additionally, the notification relay application may receive notification information from an external electronic device and provide the notification information to a user.

The device management application may manage (e.g., install, delete, or update) at least one function (e.g., turn-on/turn-off of an external electronic device itself (or a part of components) and adjustment of brightness (or resolution) of a display) of the external electronic device which communicates with the electronic device, an application running in the external electronic device, and a service (e.g., a call service, a message service, or the like) provided from the external electronic device.

According to an embodiment of the present disclosure, the application 1070 may include an application (e.g., a health care application of a mobile medical device) that is assigned in accordance with an attribute of an external electronic device. The application 1070 may include an application that is received from an external electronic device. The application 1070 may include a preloaded application and a third party application that is downloadable from a server. The names of elements of the program module 1010 according to the embodiment may be modifiable depending on the kind of operating systems installed on the device.

According to various embodiments of the present invention, at least a portion of the program module 1010 may be implemented by software, firmware, hardware, and a combination of two or more thereof. A portion of the program module 1010 may be implemented (e.g., executed) by the processor. A portion of the program module 1010 may include modules, programs, routines, sets of instructions, processes, and the like for performing one or more functions.

The term "module" used in this disclosure may represent a unit including one or more combinations of hardware, software and firmware. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific IC (ASIC) chip, a field-programmable gate array (FPGA), and a programmable-logic device for performing some operations, which are known or will be developed.

At least a part of an apparatus (e.g., modules or functions thereof) or a method (e.g., operations) may be implemented by instructions stored in computer-readable storage media in the form of a program module. The instruction, when executed by a processor, may cause the one or more processors to perform a function corresponding to the instruction. The computer-readable storage media may be the memory 830.

A computer-readable recording medium may include a hard disk, a floppy disk, a magnetic media (e.g., a magnetic tape), an optical media (e.g., a compact disc read only memory (CD-ROM) and a digital versatile disc (DVD), a magneto-optical media (e.g., a floptical disk)), and hardware devices (e.g., a read only memory (ROM), a random access memory (RAM), and a flash memory). Also, a program instruction may include not only assembly code such as things generated by a compiler but also a high-level language code executable on a computer using an interpreter. The above hardware unit may be configured to operate via one or more software modules for performing an operation of various embodiments of the present disclosure, and vice versa.

A module or a program module according to various embodiments may include the above elements, or a part of the above elements may be omitted, or additional other elements may be further included. Operations performed by a module, a program module, or other elements according to various embodiments may be executed sequentially, in parallel, repeatedly, or in a heuristic method. In addition, some operations may be executed in different sequences or may be omitted. Alternatively, other operations may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a display;

a housing including a rear housing and an external side housing which comprises a first conductive member and a second conductive member;

a nonconductive member located between the first conductive member and the second conductive member and forming part of the external side housing;

a printed circuit board (PCB) in the housing;

a communication circuit disposed on the PCB and electrically connected with the first conductive member and the second conductive member; and a ground part electrically connected with at least one of the first conductive member and the second conductive member, wherein the communication circuit feeds the first conductive member and the second conductive member and transmits or receives a signal through the first conductive member and the second conductive member, wherein the external side housing comprises an opening formed through the first conductive member, the nonconductive member, and the second conductive member, wherein at least a part of the display is viewable through the opening from outside, and wherein the nonconductive member physically spaces the first conductive member apart from the second conductive member.

2. The electronic device of claim 1, wherein the ground part includes a metal layer attached to the display.

3. The electronic device of claim 1, wherein the ground part includes a ground layer included in the PCB.

4. The electronic device of claim 1, wherein a metal strap is connected to opposite ends of the second conductive member.

5. The electronic device of claim 1, wherein the communication circuit transmits or receives signals in different frequency bands through the first conductive member and the second conductive member and performs carrier aggregation (CA) using the signals in the different frequency bands.

6. The electronic device of claim 1, wherein the communication circuit transmits or receives a signal in an overlapping frequency band through the first conductive member and the second conductive member and performs carrier aggregation (CA) using the signal in the overlapping frequency band.

7. The electronic device of claim 1, wherein the communication circuit feeds a first point of the first conductive member, wherein the first conductive member is selectively connected with the ground part at a second point and a third point, and wherein the communication circuit transmits or receives the signal in a first frequency band by an electrical path formed through the first point and the second point or transmits or receives the signal in a second frequency band by an electrical path formed through the first point and the third point.

8. An electronic device comprising:

a display;

a housing including a rear housing and an external side housing which comprises a first conductive member, a second conductive member, and a nonconductive member located between the first conductive member and the second conductive member;

a printed circuit board (PCB) in the housing;

a communication circuit disposed on the PCB and electrically connected with the first conductive member;

a ground part electrically connected with the first conductive member; and an antenna radiator disposed on the nonconductive member and electrically connected with the communication circuit and the ground part, wherein the communication circuit feeds the first conductive member to transmit or receive a signal in a first frequency band or feeds the antenna radiator to transmit or receive a signal in a second frequency band, wherein the external side housing comprises an opening formed through the first conductive member, the nonconductive member, and the second conductive member, wherein at least a part of the display is viewable through the opening from outside, and wherein the nonconductive member physically spaces the first conductive member apart from the second conductive member.

9. The electronic device of claim 8, wherein the second frequency band is in a near field communication (NFC) frequency band.

10. The electronic device of claim 8, wherein the second conductive member is electrically connected with the communication circuit and the ground part, and wherein the communication circuit feeds the second conductive member to transmit or receive a signal in a third frequency band.

11. The electronic device of claim 10, wherein the communication circuit performs carrier aggregation (CA) using the signal in the first frequency band and the signal in the third frequency band.

12. The electronic device of claim 8, wherein a metal strap is connected to opposite ends of the second conductive member.

13. The electronic device of claim 8, wherein the communication circuit feeds a first point of the first conductive member, wherein the first conductive member is selectively connected with the ground part at a second point and a third point, and wherein the communication circuit transmits/receives a first signal by an electrical path formed through the first point and the second point and transmits or receives a second signal by an electrical path formed through the first point and the third point.

14. An electronic device comprising:

a housing including a conductive member disposed on a first surface facing a first direction and a ground part connected with the conductive member and disposed adjacent to a second surface facing a second direction opposite to the first direction;

a printed circuit board (PCB); and a communication circuit disposed on the PCB and electrically connected with the conductive member;

wherein the communication circuit feeds a first point of the conductive member, wherein the conductive member is selectively connected with the ground part at a second point and a third point, and wherein the communication circuit transmits or receives a signal in a first frequency band by an electrical path formed through the first point and the second point and transmits or receives a signal in a second frequency band by an electrical path formed through the first point and the third point.

15. The electronic device of claim 14, wherein a metal strap is connected to opposite ends of the ground part.

16. The electronic device of claim 14, further comprising:

an antenna radiator interposed between the conductive member and the ground part and electrically connected with the communication circuit and the ground part, wherein the communication circuit feeds the antenna radiator to transmit or receive a signal in a third frequency band.

17. The electronic device of claim 16, wherein the third frequency band is in a near field communication (NFC) frequency band.

18. The electronic device of claim 14, further comprising:

a display, wherein the ground part includes a metal layer attached to the display.

19. The electronic device of claim 14, wherein the ground part includes a ground layer included in the PCB.

* * * * *